US008317286B2

(12) United States Patent
Ryan et al.

(10) Patent No.: US 8,317,286 B2
(45) Date of Patent: Nov. 27, 2012

(54) SYSTEM AND METHOD FOR IMPROVING THROUGHPUT FOR DUPLEX PRINTING OPERATIONS IN AN INDIRECT PRINTING SYSTEM

(75) Inventors: Cynthia J. Ryan, Lima, NY (US); Paul J. McConville, Webster, NY (US); Brent E. Fleming, Aloha, OR (US); Jeffrey R. Kohne, West Linn, OR (US); Walter S. Harris, Portland, OR (US); Trevor J. Snyder, Newburg, OR (US)

(73) Assignee: Xerox Corporation, Norwalk, CT (US)

( * ) Notice: Subject to any disclaimer, the term of this patent is extended or adjusted under 35 U.S.C. 154(b) by 470 days.

(21) Appl. No.: 12/720,505

(22) Filed: Mar. 9, 2010

(65) Prior Publication Data

US 2011/0221812 A1 Sep. 15, 2011

(51) Int. Cl.
*B41J 29/38* (2006.01)

(52) U.S. Cl. ..... 347/14; 347/16

(58) Field of Classification Search ..... 347/14
See application file for complete search history.

(56) References Cited

U.S. PATENT DOCUMENTS

| | | | |
|---|---|---|---|
| 4,429,990 | A | 2/1984 | Tamary |
| 4,593,992 | A | 6/1986 | Yoshinaga et al. |
| 4,920,382 | A | 4/1990 | Mills et al. |
| 5,132,739 | A | 7/1992 | Mauer et al. |
| 5,325,155 | A | 6/1994 | Perry |
| 5,327,204 | A | 7/1994 | Sculley et al. |
| 5,353,107 | A | 10/1994 | Sculley et al. |
| 5,523,830 | A | 6/1996 | Tamura et al. |
| 5,610,721 | A | 3/1997 | Higuchi et al. |
| 5,870,650 | A | 2/1999 | Takahashi et al. |
| 6,035,157 | A | 3/2000 | Takahashi et al. |
| 6,072,978 | A | 6/2000 | Wittmann |
| 6,141,524 | A | 10/2000 | Berkes et al. |
| 6,173,136 | B1 | 1/2001 | Fuchiwaki et al. |
| 6,176,575 | B1 | 1/2001 | Crawford et al. |
| 6,263,174 | B1 | 7/2001 | Fuchiwaki et al. |
| 6,449,455 | B1 | 9/2002 | Lebold et al. |
| 6,731,891 | B1 | 5/2004 | Calamita et al. |
| 6,763,219 | B2 | 7/2004 | Kobayashi et al. |
| 6,954,603 | B2 | 10/2005 | Brown et al. |
| 6,973,877 | B2 | 12/2005 | Jensen |
| 7,065,308 | B2 | 6/2006 | Calamita et al. |
| 7,283,271 | B2 | 10/2007 | Sesek et al. |
| 7,310,492 | B2 | 12/2007 | Kimura |
| 7,362,994 | B2 | 4/2008 | Zess et al. |
| 7,376,378 | B2 | 5/2008 | Van Bortel |
| 7,390,084 | B2 | 6/2008 | Folkins |
| 7,458,671 | B2 | 12/2008 | Leighton et al. |
| 2006/0066657 | A1 | 3/2006 | Folkins et al. |
| 2006/0239728 | A1 | 10/2006 | Van Bortel |
| 2007/0020002 | A1 | 1/2007 | Zess et al. |
| 2007/0110457 | A1 | 5/2007 | Kato et al. |
| 2007/0139496 | A1 | 6/2007 | Leighton et al. |
| 2007/0146459 | A1 | 6/2007 | Gault et al. |
| 2007/0146460 | A1 | 6/2007 | Gordon et al. |
| 2007/0146461 | A1 | 6/2007 | Islam et al. |
| 2010/0245447 | A1* | 9/2010 | Kohne et al. ..... 347/16 |

* cited by examiner

*Primary Examiner* — Uyen Chau N Le
*Assistant Examiner* — Kajli Prince
(74) *Attorney, Agent, or Firm* — Maginot, Moore & Beck, LLP

(57) ABSTRACT

A method for performing duplex printing enables increased throughput in an indirect printing system. The method includes measuring a coverage parameter for image data to be printed, and transforming operation of the printer from a first printing process timing sequence to a second printing process timing sequence in response to the coverage parameter exceeding a predetermined threshold.

16 Claims, 6 Drawing Sheets

SYSTEM AND METHOD FOR IMPROVING THROUGHPUT FOR DUPLEX PRINTING OPERATIONS IN AN INDIRECT PRINTING SYSTEM

TECHNICAL FIELD

This disclosure relates to indirect printing systems and, more particularly, to control of the image receiving member and transfix roller in such systems.

BACKGROUND

Droplet-on-demand ink jet printing systems eject ink droplets from print head nozzles in response to pressure pulses generated within the print head by either piezoelectric devices or thermal transducers, such as resistors. The ejected ink droplets, commonly referred to as pixels, are propelled to specific locations on a recording medium where each ink droplet forms a spot on the recording medium. The print heads have droplet ejecting nozzles and a plurality of ink containing channels, usually one channel for each nozzle, which interconnect an ink reservoir in the print head with the nozzles.

In a typical piezoelectric ink jet printing system, the pressure pulses that eject liquid ink droplets are produced by applying an electric pulse to the piezoelectric devices, one of which is typically located within each one of the inkjet channels. Each piezoelectric device is individually addressable to enable a firing signal to be generated and delivered for each piezoelectric device. The firing signal causes the piezoelectric device receiving the signal to bend or deform and pressurize a volume of liquid ink adjacent the piezoelectric device. As a voltage pulse is applied to a selected piezoelectric device, a quantity of ink is displaced from the ink channel and a droplet of ink is mechanically ejected from the nozzle, commonly called an inkjet or jet, associated with each piezoelectric device. The ejected droplets are propelled to pixel targets on a recording medium to form an image on an image receiving member opposite the print head. The respective channels from which the ink droplets were ejected are refilled by capillary action from an ink supply.

In some phase change or solid ink printers, the image receiving member is a rotating drum or belt coated with a release agent and the ink medium is melted ink that is normally solid at room temperature. The print head ejects droplets of melted ink onto the rotating image receiving member to form an image, which is then transferred to a recording medium, such as paper. The transfer is generally conducted in a nip formed by the rotating image member and a rotating pressure roll, which is also called a transfix roll. The pressure roll may be heated or the recording medium may be preheated prior to entry in the transfixing nip. As a sheet of paper is transported through the nip, the fully formed image is transferred from the image receiving member to the sheet of paper and concurrently fixed thereon. This technique of using heat and pressure at a nip to transfer and fix an image to a recording medium passing through the nip is typically known as "transfixing," a well known term in the art, particularly with solid ink technology.

Ink jet printers are capable of producing either simplex or duplex prints. Simplex printing refers to producing an image on only one side of a recording medium. Duplex printing produces an image on each side of a recording medium. In duplex printing, the recording medium passes through the nip for the transfer of a first image onto one side of the recording medium. The medium is then routed on a path that presents the other side of the recording medium to the nip. By passing through the nip again, an image is transferred to the other side of the medium. When the recording medium passes through the nip the second time, the side on which the first image was transferred is adjacent to the transfix roller. Release agent that was transferred from the image receiving member to the recording medium may now be transferred from the first side of the recording medium that received an image to the transfix roller. Thus, a duplex print transfers release agent to the transfix roller and multiple duplex prints may cause release agent to accumulate on the transfix roller.

Additional release agent may be applied to the transfix roller if the transfix roller comes into contact with the image receiving member during periods when there is no recording medium in the nip. The amount of release agent on the transfix roller may reach a level that enables release agent to be transferred from the transfix roller to the back side of a recording medium while an image is being transfixed to the front side of the recording medium. If a duplex print is being made, the back side of the recording medium, which receives the second image, now has release agent on it. The release agent transferred to the back side of the recording medium may interfere with the efficient transfer of ink from the image receiving member to the back side of the recording medium. Consequently, ink may remain on the image receiving member rather than being transferred to the recording medium. This inefficient transfer of ink may subsequently produce an image in which partial or missing pixels are noticeable. This phenomenon is known as image dropout. Additionally, ink remaining on the image receiving member may require the image receiving member to undergo a cleaning cycle.

To aid in the transfer of ink from the image receiving member to the back side of a recording medium, some printers perform the printing process using a printing process phasing or timing sequence that prevents the transfix roller from contacting the image receiving member. This printing process timing sequence minimizes the release agent on the transfix roller and thus minimizes the amount of release agent that may be transferred to the surface of the recording media. Use of a printing process timing sequence of this type, however, reduces printer throughput during duplex printing operations. Therefore, performing duplex printing in a manner that improves throughput without subjecting image quality to dropout and the like is useful.

SUMMARY

A printer has been developed that monitors image content to be printed and selects a specific printing process timing sequence to achieve maximum image throughput while maintaining image quality during printing. The printer includes an image receiving member, a print head configured to eject ink drops onto the image receiving member to form an ink image, a transfix roller configured to move towards and away from the image receiving member to form a transfixing nip with the image receiving member selectively, a release agent applicator configured to engage the image receiving member selectively to apply release agent to the rotatable imaging member, and a controller configured to analyze image data used to generate firing signals to operate the printhead and to transform operation of the printer from a first printing process timing sequence to a second printing process timing sequence in response to the image data exceeding a predetermined threshold.

A method has been developed for transforming operation of a printer to correspond to a measurement of image content in image data to be printed. This method may enable increased throughput in an indirect printing system in response to image data having appropriate image content. The method includes measuring a coverage parameter for image data to be printed, and transforming operation of the printer from a first printing process timing sequence to a second printing process timing sequence in response to the coverage parameter exceeding a predetermined threshold.

BRIEF DESCRIPTION OF THE DRAWINGS

The foregoing aspects and other features of a system that evaluates image content of images to control the printing process timing sequence are explained in the following description taken in connection with the accompanying drawings.

DETAILED DESCRIPTION

Figure 1:
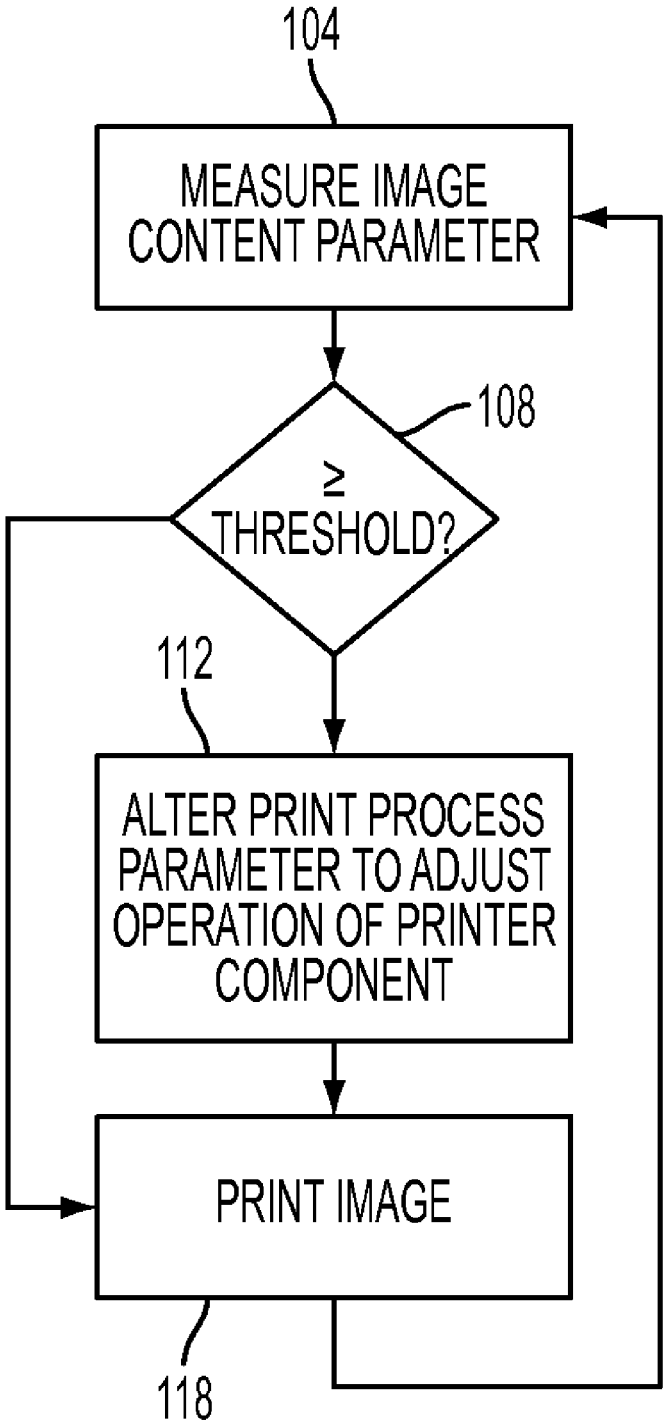
FIG. 1 is a flow diagram of a process that evaluates image content of images to be printed and selects a printing process timing sequence based on printing process timing sequence criteria and then transforms printer component operation in accordance with that selection.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multifunction machine, or the like. The description presented below is directed to a printing system that monitors image content and adjusts the motion of its image receiving member and movement of its transfix roller to increase the throughput of media sheets while avoiding the problems with image dropout caused by the deposition of release agent onto the media sheets. A "media sheet" or "recording medium" as used in this description may refer to any type and size of medium that printers in the art create images on, with one common example being letter sized printer paper. Additionally, the printing system described below may have embodiments that can monitor image content of images that will be placed onto media sheets, and determine whether the system may be adjusted to increase throughput based on this image content.

A process for altering operation of a printer to accommodate varying image content is shown in FIG. 1. The process begins with measurement of image content for an image to be printed (block 104). The term 'image content' is described in more detail below. Image content may be determined at certain times relative to operation based on sophistication or configuration of the printing device. As example, image content may be determined prior to actual imaging, such as by analysis of an image as it is "ripped", determined concurrent with imaging, such as by counting pixels within predetermined regions, or determined after completing an image, such as by scanning the image on the image receiving member before transfer or on media sheets, if directly printed or after transfer, if transferred from an imaging member.

With continued reference to FIG. 1, the measured image content parameter is compared to a predetermined threshold (block 108). If the measurement is greater than the predetermined threshold, then the image is printed with a default process (block 118). If the measurement is equal to or less than the predetermined threshold, then a print process parameter is altered to adjust operation of a printer component (block 112). The image is then printed (block 118). Print process parameters, also termed process profile, process control or similar term variations, may be adjusted independently for simplex and duplex operation, and may or may not be different depending on the full range of variables for the print process to be used to produce an image. Process parameters within those two basic modes of operation may be altered in limited fashion, such as the example discussed below, or may be very extensive, even though some profiles may be subtly different in some aspects. One example might be monitoring image receiving member temperature over a large batch print job where temperature could unavoidably rise above a nominal operation window and in response, the transfix velocity profile and transfix load may be altered. The change in process parameters in this example would not be optimized for image transfer efficiency or image quality results alone but rather, consistent with the focus of the systems and methods described herein, which may not be present in other implementations, but instead may be performed as an optimization compromise between image quality, image throughput, and oil consumption.

One of the print process parameters altered below is described as velocity or speed of a rotating member. The term velocity or speed is used throughout this document as a reference to any steady state rate of motion, any varying motion due to acceleration or deceleration, or any combination of steady state, acceleration and deceleration motion throughout or during a portion of a particular operation of an image receiving member, or other motor driven component used in an imaging operation of the printer. For example, while a lower speed or velocity may be used to provide an advantage under some circumstances, a higher velocity or speed may be useful for other circumstances. Such a reference could also be understood to mean multiple different speeds, continuously variable speed profiles, and so forth. The range of variables contributing to attaining maximum throughput in conjunction with minimal compromise to image quality offers challenges for any particular imaging system and image job so these variables are not subject to strict formulation. Rather, the variables selected and their value ranges are flexible for intelligent automated optimization of the imaging process. The variables include but may not be limited to motion control, transfix load, image density by region of the image, color content, simplex or duplex printing, number of image repetitions, thermal changes over applicable conditions (environment or duration of print job), media type, number of images to be produced in a given job, circumference or diameter of the transfix roller, amount of media sheet length remaining in the print job, and the intended image quality based on resolution. Consequently, numerous process profiles may be employed to attain the best balance of objectives, including those affected by user input, such as media type and image resolution. Central to these print parameter adjustment factors is knowledge about the images being produced. Intelligent action taken based on image analysis may therefore be partly formulation, where optimization is based upon known trends, and partly unique observation based on a given system, where weighting and values may be assigned to those trends within practical limits of a particular product implementation.

When measuring image content, the printer being described is being operated with reference to the image content of one or more print images used to generate ink images. These images may be denoted as a current print image, a previous print image, or a next print image. As used herein, the terms print image and current print image refer to the image being executed. The term next print image refers to an image that may have been at least partially processed by the controller, but not yet executed. Next print image may also be understood as "no subsequent print job," if no immediate print job follows the current image. The term previous print image refers to a print that has already been executed, and a measurement of its image content retained in a form that enables the measurement to be used to alter the print process of the current print image. In the context of a duplex print image, the current print image may be the first side printed and the next print image may be the second side printed. The term executed refers to the process in which the printer implements making a print by, for example, applying release agent to an image receiving member, ejecting ink from one or more printheads to form an ink image on the image receiving member, and transfixing the ink onto a recording medium, such as a sheet of media, by feeding the recording medium between a nip formed by the image receiving member and a movable transfix roll.

As used in this document, measuring image content of a print image refers to a process in which the attributes of a print job are determined and placed in a format that can be utilized in logical decisions and analysis for operation of the imaging device. Examples of a measurement, which may be referred to as a score, include, but are not limited to, counting, tallying, finding a maximum, finding a minimum, calculating (such as a percentage), converting to an integer scale, or the like. Examples of attributes include, but are not limited to, the total number of pixels in an area to be printed, the number of pixels within specified areas of a total image to be executed, the spatial relationship between the ink on the image receiving member and the media or other printer components, the quantity or occurrence of pixel patterns in a print image, the nature of the colors present, or the like. The logical decisions and analysis performed with reference to the attributes may be the same or different based on whether the image is a current print image, a next print image, or a previous print image. For example, comparison of an image content measurement to a predetermined threshold may use the same or different thresholds for current print images, next print images, or previous print images. Additionally or alternatively, other criteria such as duty cycle or a thermal state may be used to govern a logical decision or analysis. Also, comparisons described in this document are frequently described as exceeding a threshold. This description is meant to encompass the value being greater than the threshold or less than the threshold depending on the context of the comparison. Thus, exceeding a threshold may refer to a value greater than a maximum in one context and referring to a value less than a minimum in another context. The term "timing" is intended to identify differences in the print process that encompass mechanical device motion, phasing, synchronization, or position relative to a printing operation as well as other possible modifications in which event timing is not required or is a secondary concern.

Figure 2:
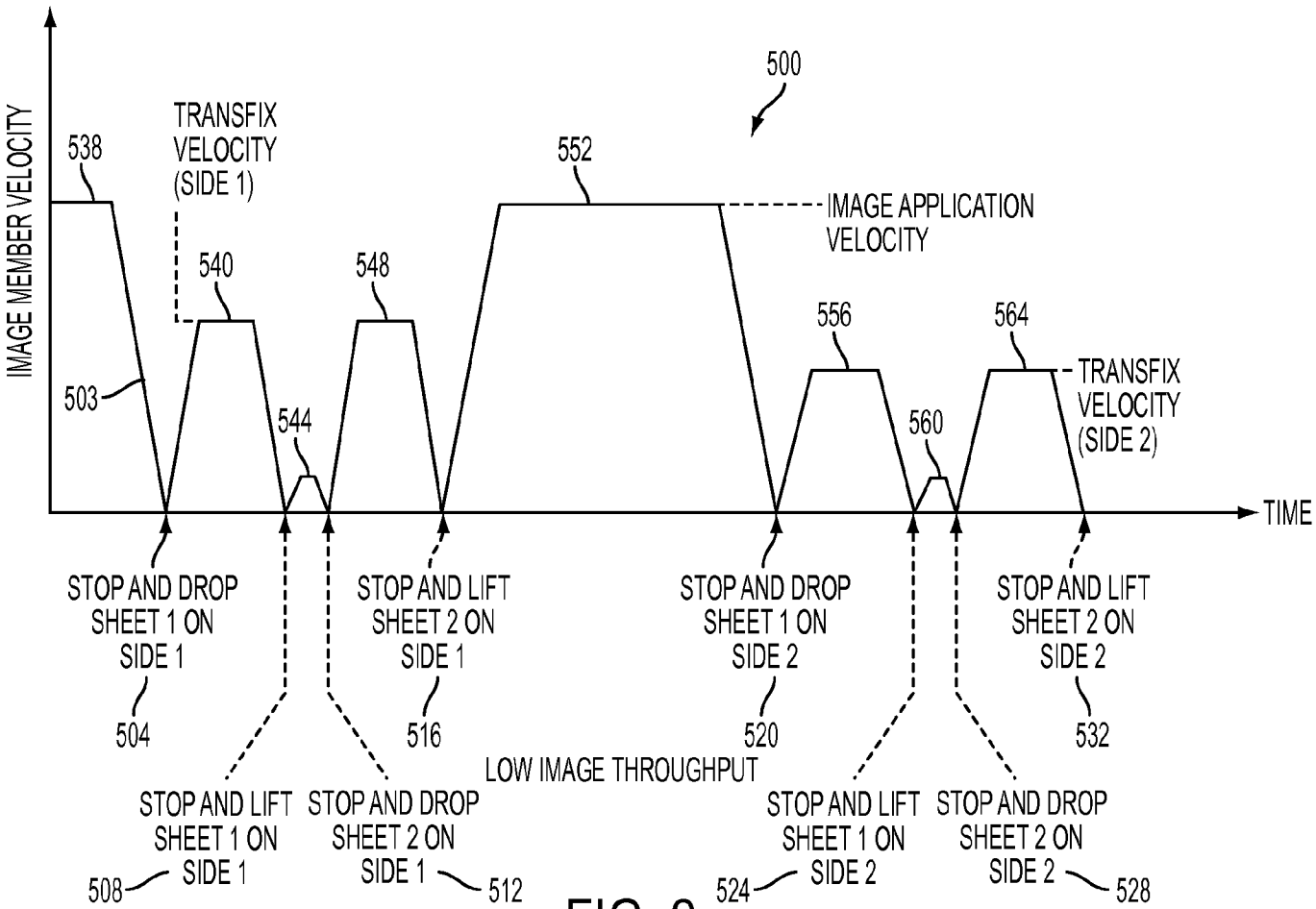
FIG. 2 is a timing diagram which depicts an example of a printing process timing sequence where the evaluation of the image content to the printing process timing sequence criteria results in low throughput.

One printing process timing sequence that transforms operation of a printer in accordance with a predetermined printing process timing sequence in response to an image content parameter for image data to be printed exceeding a predetermined threshold is shown in FIG. 2. This process lowers throughput to avoid a loss of image quality due to dropout and may be referred to as "stop, drop and roll". The process begins with the image receiving member rotating at an imaging speed as the first side image is applied to the image receiving member surface (538). After the first side image is completed the imaging member is decelerated (503) to a "stop" (504) at a position where the leading edge of the first media sheet intercepts the image. The transfix roller is moved to a position, or "dropped", on the leading edge of the first media sheet, generating the nip for transferring the image to the first media sheet. The image receiving member accelerates from a stop to a first-side transfix speed (540) causing the transfix roller to "roll" and a first side image is transferred to the first media sheet. The image receiving member then decelerates to a stop (508) as the trailing edge of the first media sheet reaches the nip. The transfix roller is moved away from the image receiving member. It should be noted that the transfix roller only contacts paper during this roll operation. The image receiving member then rotates through the inter-document gap at a lower speed (544) until it stops again (512) when the leading edge of the second media sheet aligns with the second first side image. The transfix roller returns to the position where it forms a nip on the leading edge of the second media sheet. The image receiving member accelerates to the transfix speed (548) and the image is transferred to the first side of the second media sheet. The image receiving member decelerates to a stop (516) as the transfix roller reaches the trailing edge of the second media sheet. The transfix roller is then moved away from the image receiving member.

As the process continues, the image receiving member accelerates to an image formation speed (552) and one or more second side images are formed on the image receiving member. The image receiving member slows to a "stop" (520) at a position where the leading edge of the first media sheet intercepts the image. The transfix roller is then "dropped" on the leading edge of the first media sheet, generating the nip for transferring the second side image to the first media sheet. The image receiving member accelerates to a second side transfix speed (556) allowing the first media sheet to "roll" between the imaging member and the transfix roller and a second side image is transferred to the second side of the first medium. The transfix speed for the second side is lower than for the first side in this printing system but could be the same speed or a faster speed as well. The image receiving member then decelerates to a stop (524) as the transfix roller reaches the trailing edge of the first media sheet. The transfix roller is then lifted away from the nip. It should be noted that the transfix roller is making contact with the first side image and paper during this roll operation. The image receiving member rotates through the inter-document gap, also called the inter-copy gap, at a lower speed (560) and then stops (528). The transfix roller returns to form a nip with the leading edge of the second media sheet. The image receiving member begins to rotate and the transfix roller rolls over the second media sheet for transfer of a second side image onto the second media sheet (564). The image receiving member then decelerates to another stop as the trailing edge of the second media sheet reaches the nip (532). The transfix roller is lifted away from the imaging member. The image member begins to rotate as the media sheet leaves the imaging member and the system is ready for another printing cycle.

Printers employing an offset printing process require precise positioning of the transfix roller, image recording medium, and image receiving member. The distance from the ink to the edge of the media sheet, also called a "margin", can be 4.2 mm around the leading, trailing, and both side edges, when adhering to industry standards. In the case of a nominal and typical "stop, drop, and roll" process, the image receiving member is first stopped, the leading edge of the media sheet is fed just beyond an open gap between the transfix roller and the image receiving member, and the roller is then loaded. The transfix roller engaging and loading mechanism requires a small amount of time to move the roller from its unloaded rest position to where it contacts the drum and additionally applies the necessary transfixing force. Ideally, the roller is loaded in the middle of the 4.2 mm margin at the leading edge so the roller does not contact the image receiving member and become contaminated by release agent. This action also places the roller ahead of the leading edge of the inked image to be transferred from the image receiving member. The image receiving member begins to rotate after the transfix roller loading system has been given sufficient time to generate the minimum required transfix load. If rotation begins too soon when the transfix roller has not yet achieved the minimum required load, the leading edge of the inked image will transfer poorly. For example, the inked image may not adhere to the recording media well because the transfix nip was not fully developed and the pressure was too low. The timing requirements necessary for the successful performance of this operation limits printer throughput.

In order to achieve higher printer throughput, the transfix roller can be loaded against an image receiving member that is rotating. Thus, stop and start motions of the image receiving member are eliminated. When the transfix roller loading system is commanded to engage the transfix roller, the actual circumferential position on the image receiving member where roller contact is made and the minimum transfixing load is achieved varies by an amount greater than the 4.2 mm leading edge margin. Therefore, synchronizing the transfix roller to become fully loaded against the image receiving member while the leading edge of the media sheet is present in the nip is not practically feasible. Another method that has been employed is to first load the transfix roller against the image receiving member prior to the arrival of the media sheet and the position on the image receiving member where the leading edge of the inked image is. This method enables the transfix roller to provide sufficient transfixing pressure against the image receiving member before the media sheet is fed into the transfix nip. Thus, the transfix roller "rolls onto" the media sheet. This mechanical phasing or timing must be coordinated to enable the media sheet and inked image on the image receiving member to rendezvous in the transfix nip for proper ink to media alignment. The drawback with this method is that the transfix roller picks up release agent from the image receiving member because the two rotating members are in contact prior to the arrival of the recording media.

A similar synchronization issue occurs at the trailing edge of the sheet. When performing a "stop and lift" operation, the transfix roller disengages from the image receiving member after the inked image has been transferred off the image receiving member, but before the trailing edge of the media sheet. Within this zone, which can be 4.2 mm, as an example, the printer can accurately synchronize the "stop and lift" action, but the image receiving member must be stopped and printer throughput is decreased as a result. If the transfix roller is disengaged while the image receiving member is in motion, the unloading must not begin until the inked image has been fully transfixed from the image receiving member. Otherwise, the trailing edge of the inked image may be transfixed poorly. The length of time required for unloading and removing the transfixing roller system may enable the trailing edge of the media sheet to exit the transfix nip before the transfix roller lifts off the image receiving member. Thus, the transfix roller "rolls off" the trailing edge of the media sheet and then disengages from contact with the image receiving member. During the time that the transfix roller contacts the image receiving member without an intervening media sheet, the transfix roller picks up release agent from the image receiving member. In simplex printing, the presence of small amounts of release agent on the transfix roller has minimal harmful print quality side effects. However, in duplex printing, even a small amount of release agent on the transfix roller picked up by either "roll-on" or "roll-off" can cause print quality defects on duplex prints, specifically image dropout.

The "stop, drop, and roll" and "stop, lift" processes help reduce exposure of the transfix roller to release agent and the image dropout that may arise from the presence of release agent on the image receiving member because media is always present in the nip when the transfix roller is loaded against or unloaded from the image receiving member. This method, however, requires numerous stops and restarts of the image receiving member that reduce the image throughput rate. If the image content of the image data to be printed corresponds to a level that is not affected by the presence of release agent on the transfix roller and thus, does not require this precision in printer operation, then printing components, such as the transfix roller and imaging drum, may be operated in the manner of "roll on" and "roll off" so a greater proportion of the printing cycle is spent in motion and at an operational position that yields a higher throughput.

Figure 3:
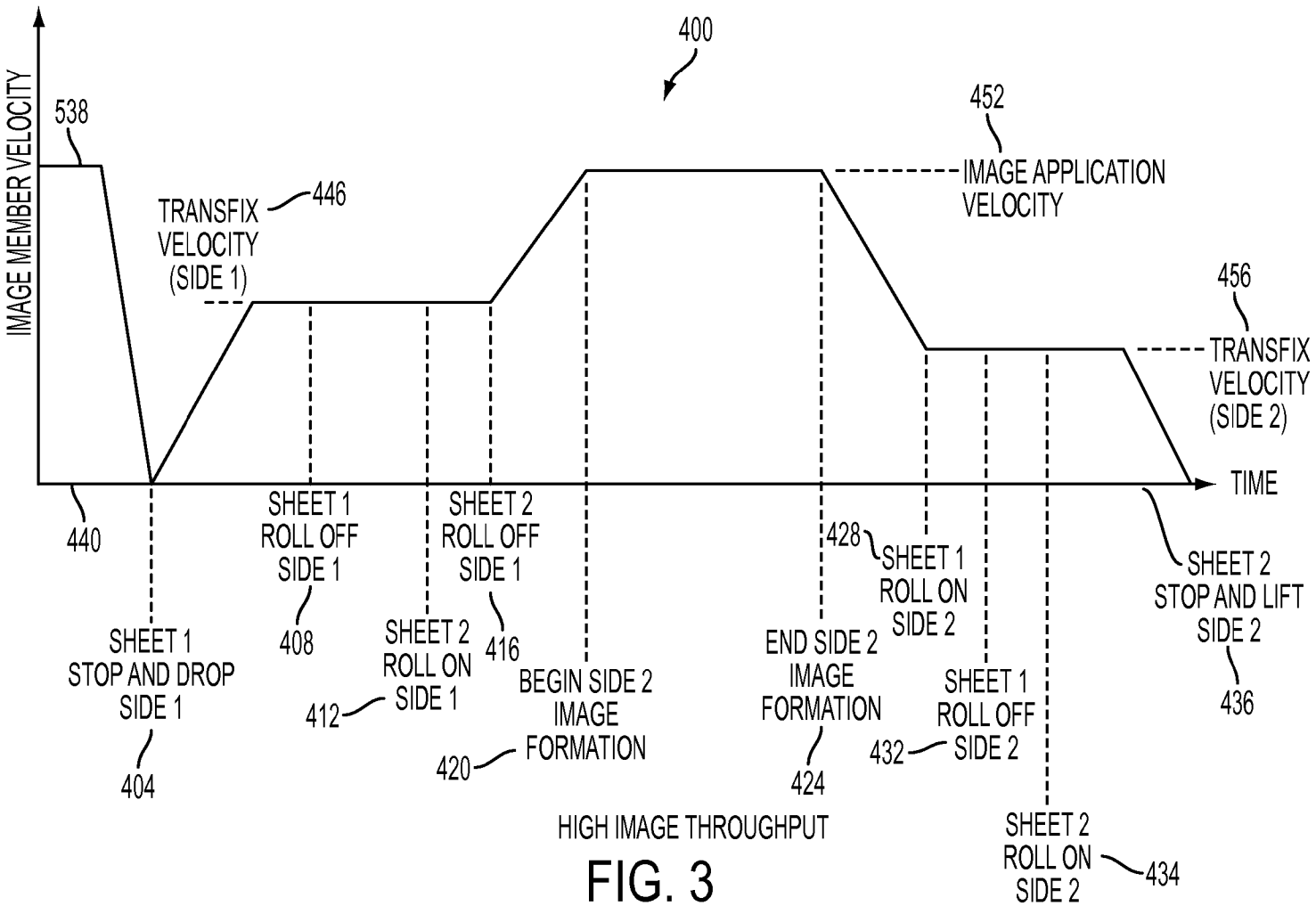
FIG. 3 is a timing diagram which depicts an example of a printing process timing sequence where the evaluation of the image content to the printing process timing sequence criteria results in high throughput

A printing process timing sequence that transforms operation of a printer to another printing process timing sequence in response to an image content parameter for image data to be printed exceeding a predetermined threshold is shown in FIG. 3. This process is an example of a process that may be used to achieve high image throughput because the image content indicates a low likelihood of showing a loss of image quality, such as dropout. FIG. 3 depicts a process of duplex printing for a set of two media sheets, but the reader should understand that this process is only one possible embodiment, and that the same technique may be applied to one, three, or more sheets in a duplex printing system.

The process begins with the image receiving member rotating at an imaging speed (538). The image receiving member is then decelerated to a stopped position (404) at a position where the leading edge of the first media sheet intercepts the image. The transfix roll is moved to a position, or "dropped", on the leading edge of the first media sheet, generating the nip for transferring the image to the first media sheet (404). The rotating member then accelerates to the transfix speed (446). The image receiving member continues to rotate at the transfix speed during the transfixing of the first side image to the first media sheet, rolls off the trailing edge of the first sheet and through the inter-document gap between the first and second media sheets (408 and 412), rolls onto the leading edge of the second sheet, transfixes the first side image on the second media sheet, and rolls off of the second media sheet (416). At this point, both of the first-side images in the disclosed embodiment have been transfixed to the first-sides of the media sheets in the duplex printing system.

Continuing to refer to FIG. 3, the image receiving member is now ready to receive at least one new image which forms a second side image for one of the media sheets, although the process in FIG. 3 depicts two second side images being formed for transfixing to each of the second sides of the media sheets. At this point, the embodiment of the process being discussed shows the image receiving member accelerating to a higher speed (452) for the printing of the second side images onto the image receiving member (420). While the example embodiment accelerates the image receiving member to a higher speed for imaging, the imaging process may be done with a speed that matches the first-side transfix speed, or even operates at a lower speed than the first side transfix speed. The speed of the image receiving member during image formation, however, is likely to be higher than the transfix speed to improve throughput for the printing system. All of these possible speeds are envisioned beyond the current embodiment. The image receiving member continues its rotation at the imaging speed until the new pitches have been formed upon its surface (424).

The process of FIG. 3 continues with the image receiving member changing speed to a transfix speed (456) for transfixing the first, second side image onto the second side of the first media sheet. When the transfix speed has been reached and the first media sheet is in position, the transfix roller is dropped and rolled on the leading edge of the first media sheet (428). In the present embodiment, the transfix speed for the second sides of the media sheets is slower than the transfix speed for the first sides of the media sheets, but the second side transfix speed may match or exceed the transfix speed for transfixing the first sides of the media sheets in alternative embodiments. The image receiving member continues at the second side transfix speed, while transfixing the first second side image to the second side of the first medium, rolling off the trailing edge of the first media sheet (432) and through all inter-document gap and onto the leading edge of the second sheet (434), and transfixing the second, second side image to the second side of the second media sheet. As the trailing edge of the second media sheet approaches the nip the image receiving member is brought to a stop (436) and the transfix roller is moved away from the nip to complete the cycle.

Figure 4:
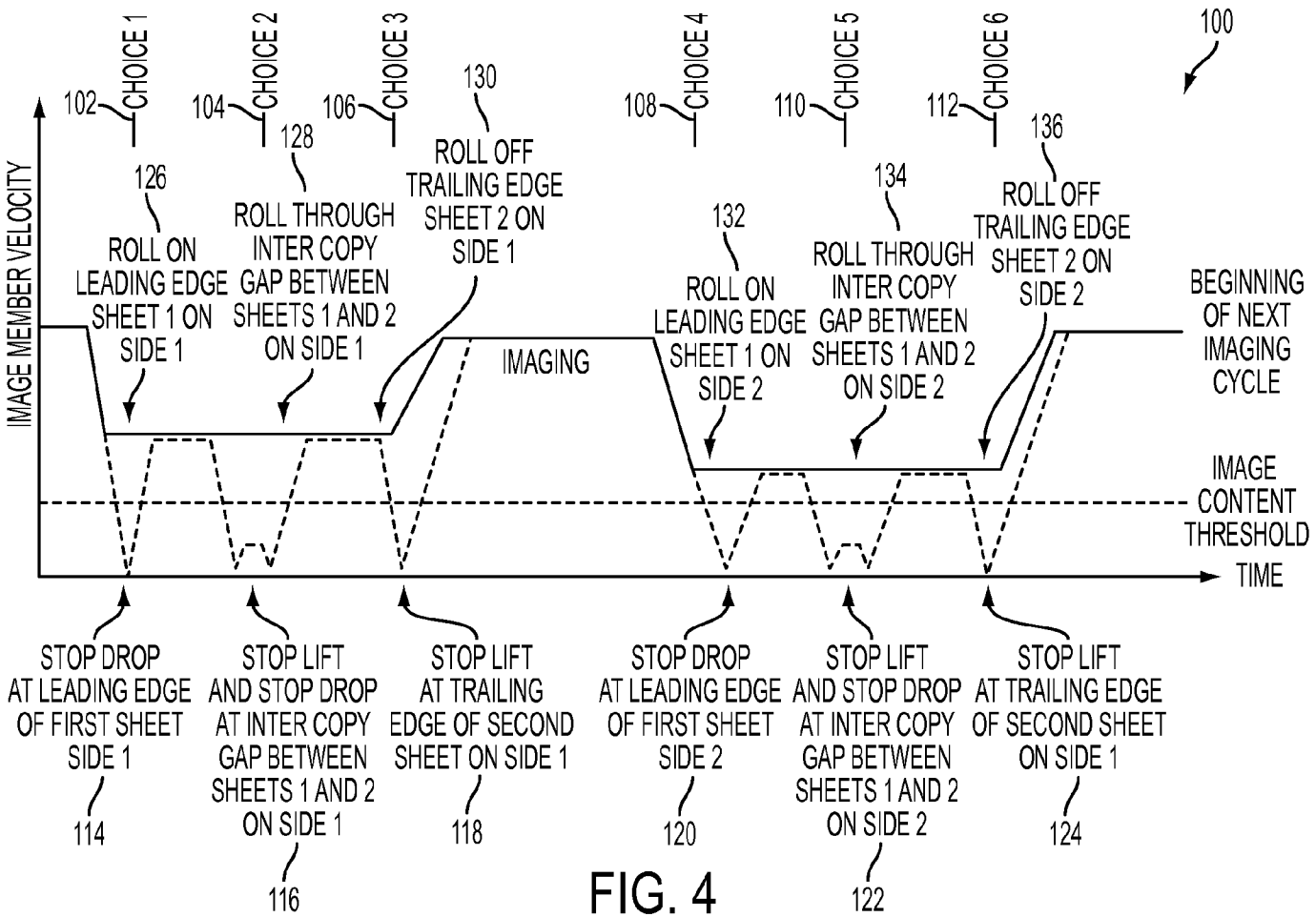
FIG. 4 is a timing diagram showing that one or more phases of an example print process can modified to increase throughput if the images to be printed meet an image content threshold.

While FIG. 2 and FIG. 3 depict specific combinations of actions that have been discussed with reference to a two pitch embodiment during a duplex operation, the reader should appreciate that six opportunities for transformation of the printer operation are presented by a two pitch embodiment. These opportunities are illustrated in FIG. 4. The general process (100) shows two timing diagrams superimposed over one another. Note that the actual time duration difference due to process alternatives is implied but for simplicity of recognizing the timing/phasing relationship, the actual time saved with the improved throughput opportunities is not depicted. Six throughput improvement opportunities or choices are shown as 102, 104, 106, 108, 110, and 112. Independent decisions can be made for a variety of reasons, such as based on image content and other factors, at each of these locations to transform printer operation. Operation of the printer may be transformed at the leading edge of a first media sheet (102) as being either "roll-on" (126) or "stop drop" (114), at the inter-document gap between the two pitches (104) as being either "roll-through" (128) or "stop lift and stop drop" (116), at the trailing edge of the first media sheet (106) as being either "roll-off" (130) or "stop lift" (118), at the leading edge of the second media sheet, (108) as being either "roll-on" (132) or "stop drop" (120), at the inter-document gap between the two pitches of side 2 (110) as being either "roll-through" (134) or "stop lift and stop drop" (122), and at the trailing edge of the second media sheet (112) as being either "roll-off" (136) or "stop lift" (124). In the aforementioned description, "roll-through" is defined as the motion associated with "rolling off" the trailing edge of one media sheet, through the inter-copy gap, and "rolling onto" the leading edge of the next media sheet. Each decision point can be made independent of the other decision points resulting in many possible combinations of actions that may occur at these opportunities for improved throughput at a particular image quality objective. While the description above pertains to duplex printing with a two pitch image member, duplex printing may be performed with only a single pitch or with three or more pitches. In a print process that operates on a single sheet, printer operation may be transformed at four of the opportunities noted above. These opportunities may be described as previously done for the 2 pitch description with the omission of the intercopy gap choices (104 and 110), but the rest of the choices (102, 106, 108, and 112) remain the same. In a print process employing three or more sheets, printer operation may be transformed at eight or more opportunities. These opportunities can be described as previously done for the 2 pitch description with the addition of extra intercopy gaps allowing for the extra choices.

In FIG. 2-FIG. 4, the term "stop" is used while describing the motion of the image receiving member. It can also mean slowing the image receiving member to a near zero velocity without actually reaching zero velocity. When the image receiving member slows to a "stop" or near zero velocity, the transfix roller is able to either engage or disengage from the image receiving member while media is present, thereby ensuring the transfix roller does not contact the image receiving member and pick up release agent, which could cause subsequent duplex dropout. However, a "stop" or very slow velocity of the image receiving member reduces printer throughput. Conversely, when the term "roll on" or "roll off" are used, the transfix roller is engaged while the image receiving member is moving at transfix or near transfix velocity as the media either enters or exits the transfix nip. These velocity states are described in simple terms but since attaining any velocity is not instantaneous, these processes are intended to include appropriate acceleration and deceleration transitions.

Figure 5:
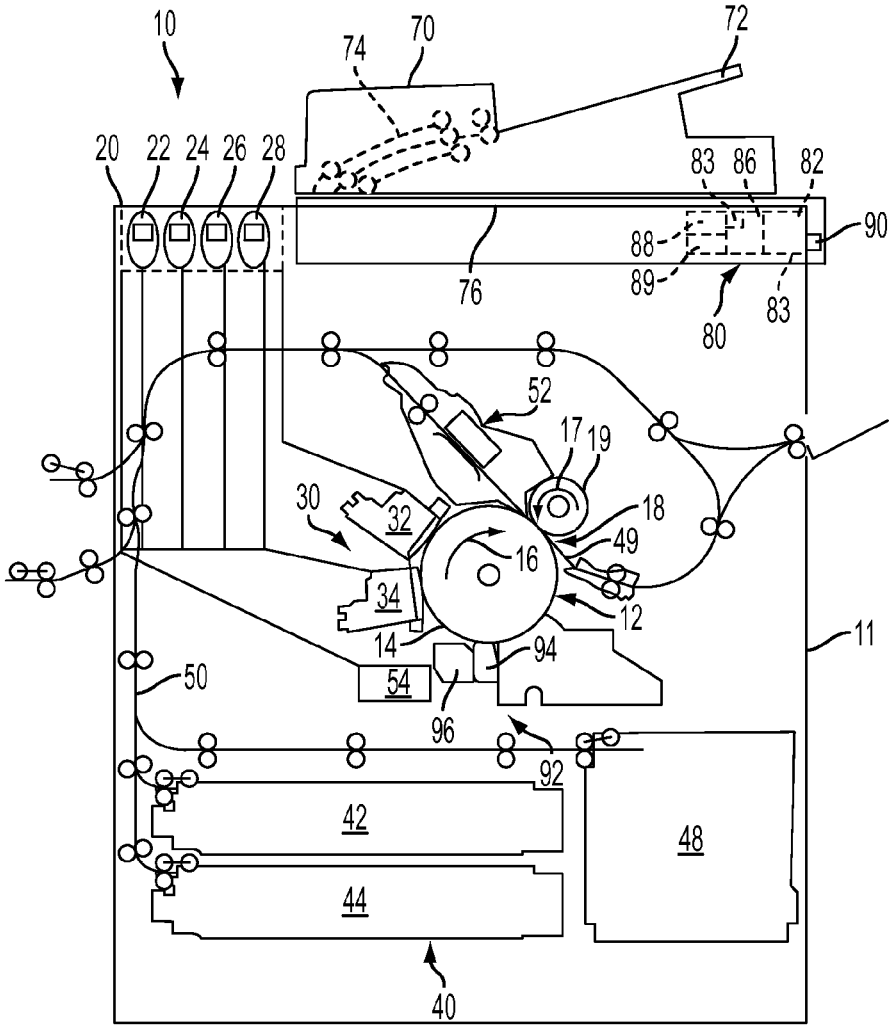
FIG. 5 is a schematic, side elevation view of an ink jet printer that implements the processes shown in FIG. 1-FIG. 4.

Referring now to FIG. 5, an embodiment of an image producing machine, such as a high-speed phase change ink image producing machine or printer 10, is depicted. As illustrated, the machine 10 includes a frame 11 to which are mounted directly or indirectly all its operating subsystems and components, as described below. To start, the high-speed phase change ink image producing machine or printer 10 includes an image receiving member 12 that is shown in the form of a drum, but can equally be in the form of a supported endless belt. The image receiving member 12 has an imaging surface 14 that is movable in the direction 16, and on which phase change ink images are formed. A transfix roller 19 rotatable in the direction 17 is loaded against the surface 14 of drum 12 to form a transfix nip 18, within which ink images formed on the surface 14 are transfixed onto a heated media sheet 49.

The high-speed phase change ink image producing machine or printer 10 also includes a phase change ink delivery subsystem 20 that has at least one source 22 of one color phase change ink in solid form. The example phase change ink image producing machine or printer 10 is a multicolor image producing machine. The ink delivery system 20 includes four (4) sources 22, 24, 26, 28, representing four (4) different colors CMYK (cyan, magenta, yellow, black) of phase change inks. The phase change ink delivery system also includes a melting and control apparatus (not shown) for melting or phase changing the solid form of the phase change ink into a liquid form. The phase change ink delivery system is suitable for supplying the liquid form to a printhead system 30 including at least one printhead assembly 32. The phase change ink image producing machine or printer 10 is a wide format high-speed, or high throughput, multicolor image producing machine. The printhead system 30 includes multiple multicolor ink printhead assemblies, 32 and 34 as shown. In the embodiment illustrated, each printhead assembly further consists of two independent printheads. The total number of four printheads are staggered so the array of printheads covers substantially the full imaging width of the largest intended media size. Solid ink printers may have one or any number of any size printheads arranged in any practical manner.

As further shown, the phase change ink image producing machine or printer 10 includes a substrate supply and handling system 40. The substrate supply and handling system 40, for example, may include sheet or substrate supply sources 42, 44, 48, of which supply source 48, for example, is a high capacity paper supply or feeder for storing and supplying image receiving substrates in the form of cut sheets 49, for example. The substrate supply and handling system 40 also includes a substrate handling and treatment system 50 that has a substrate heater or pre-heater assembly 52. The phase change ink image producing machine or printer 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80, for example, is a self-contained, dedicated mini-computer having a central processor unit (CPU) 82 with electronic storage 84, and a display or user interface (UI) 86. The ESS or controller 80, for example, includes a sensor input and control circuit 88 as well as a pixel placement and control circuit 89. In addition, the CPU 82 reads, captures, prepares, and manages the image data flow between image input sources, such as the scanning system 76, or an online or a work station connection 90, and the print head assemblies 32 and 34. As such, the ESS or controller 80 is the main multi-tasking processor for operating and controlling all of the other machine subsystems and functions, including the duplex printing process discussed herein.

The controller 80 may be implemented with general or specialized programmable processors that execute programmed instructions. The instructions and data required to perform the programmed functions may be stored in memory associated with the processors or controllers. The processors, their memories, and interface circuitry configure the controllers to perform the printing processes, described more fully below, that enable the image receiving member 12 to continue to rotate during some duplex printing operations. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits. Multiple controllers configured to communicate with a main controller 80 may also be used.

The controller is coupled to an actuator 96 that rotates the image receiving member. The actuator is an electric motor that the controller may operate at multiple speeds and also halt to carry out the printing process timing sequence. The controller of the present embodiment also generates signals for operating the components that position the transfix roller with reference to the image receiving member.

In operation, image data for an image to be produced are sent to the controller 80 from either the scanning system 76 or via the online or work station connection 90 for processing and output to the printhead assemblies 32 and 34. Additionally, the controller determines and/or accepts related subsystem and component controls, for example, from operator inputs via the user interface 86, and accordingly executes such controls. As a result, appropriate solid forms of differently colored phase change ink are melted and delivered to the printhead assemblies. Additionally, inkjet control is exercised with the generation and delivery of firing signals to the print head assemblies to form images on the imaging surface 14 that correspond with the image data. Media substrates are supplied by any one of the sources 42, 44, 48 and handled by substrate system 50 in timed registration with image formation on the surface 14. The timing of the transporting of the media sheets to the nip, the regulation of the rotation speed for the image receiving member, and the positioning are transfix member are performed by the processes described above for appropriate duplex printing operations. After an image is fixedly fused to an image substrate, it is delivered to an output area.

In the embodiments disclosed in FIG. 1-FIG. 5 above, the controller selectively rotates the image receiving member in accordance with one of the printing process timing sequences described above, while also controlling the transfer of release agent to the transfix member. Other printing process timing sequences are possible, either in addition to these processes or as alternatives to these processes. The processes described above in FIG. 3 enables the inter-document gap to rotate through the nip during first side printing as the release agent is deposited on a portion of the transfix roll. The continued rotation of the image receiving member, however, causes the transfix roller to contact only the second side of each media sheet with a portion of the transfix roller that was not exposed to release agent from the inter-document gap. The transfix roller may collect additional release agent immediately after the final media sheet exits the nip for first side printing, and immediately before the first media sheet enters the nip for second side printing. As the first media sheet passes through the nip for second side printing, the portion of the transfix roller that contacted release agent is in rotational contact with the image transferred to the first side. The release agent is transferred from the transfix roller onto the first side of the media sheet. This action removes release agent from the transfix roller and prepares the transfix roller for the next duplex printing cycle.

Figure 6:
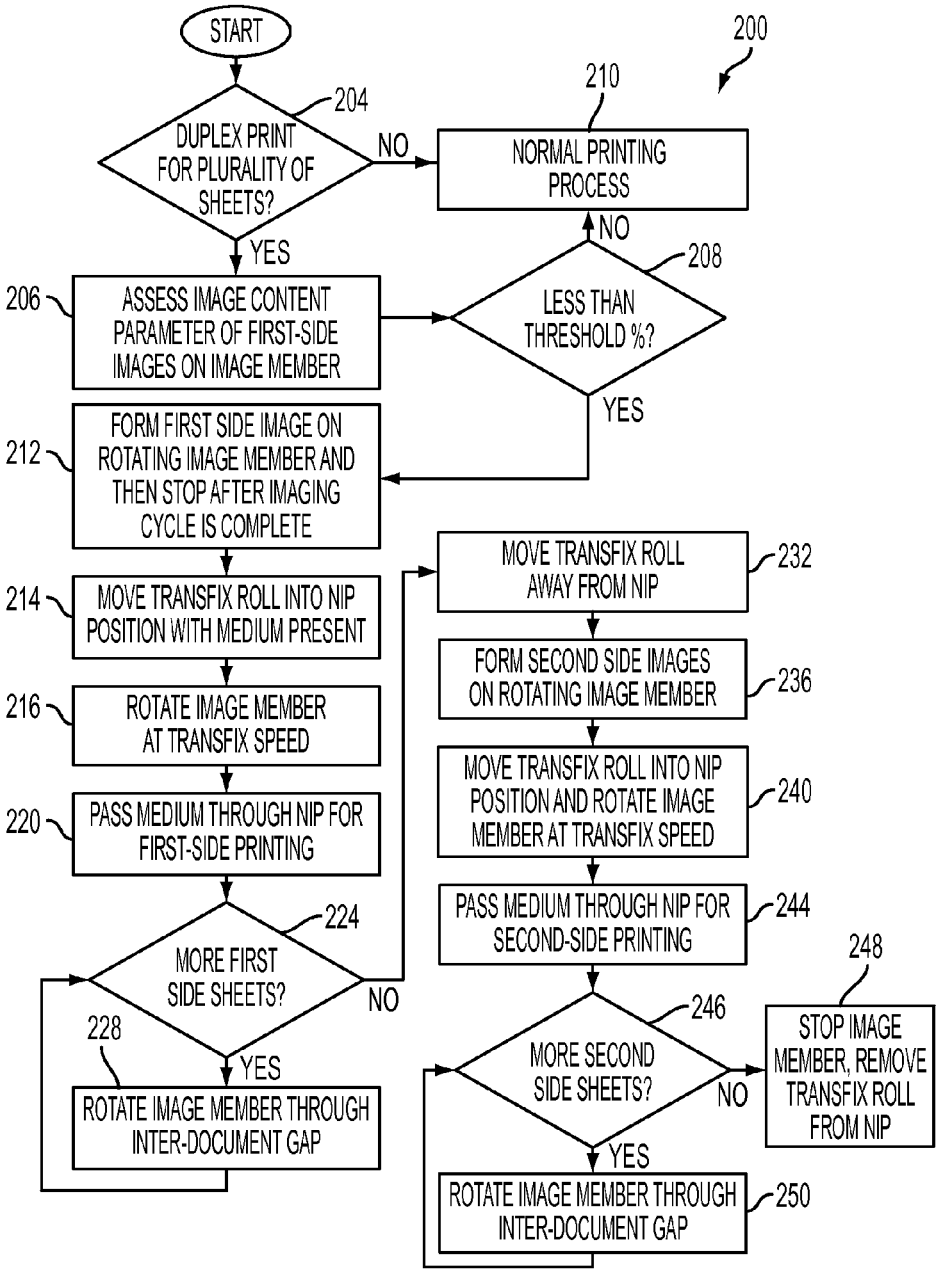
FIG. 6 is a flow diagram of an example of a duplex printing process that calculates an ink coverage parameter to control continual movement of the image receiving member and positioning of the transfix roller.

A process that may be used to implement the process of FIG. 3 is depicted in FIG. 6. While FIG. 3 depicts the motion used when performing a higher image throughput print process, FIG. 6 describes an example of a multiple sheet duplex process where image content is first analyzed and then either the higher image throughput printing process is used or an alternative or nominal process is used. Note that a discussion of all of the decision influences that might be encountered is impractical so this example is for a specific case.

The process 200 starts with detection of whether a duplex printing process for a plurality of media sheets is active (block 204) and if such a duplex printing operation is not active, then another printing process may be performed (block 210). The term "duplex" here means that each side of a two-sided piece of print media will have an image transferred to it during the printing process. If the printing system is not requested to conduct a duplex printing operation for more than one media sheet, then another printing process timing sequence may be selected to operate the printer. In this document, a "plurality of sheets" is used to describe two or more pieces of printable media that are being processed at one time through the duplex printing system. For example, a known embodiment disclosed by FIG. 2 handles two (2) media sheets, wherein the first side of each media sheet is transfixed by the image receiving member and transfix roller before the second sides of the sheets are transfixed by the image receiving member and transfix roller. Other embodiments could conduct the same operation on three or more media sheets forming a plurality of media sheets depending on the size of the image receiving member and other related parameters. Also, as noted above, a duplex operation may be performed on an image receiving member having a single pitch that prints both sides of a single media sheet. The controller 80 executing the stored instructions determines whether a duplex mode for printing a plurality of media sheets is active.

Again referring to FIG. 6, the process next determines an image content parameter or set of image content parameters on a document imaging portion of the image receiving member that results from printing image data stored in a memory of the printing system (block 206). As used in this document, determining an image content parameter refers to a process in which the attributes of an image are determined and placed in a format that can be utilized in logical decisions and analysis for operation of the imaging device. Examples of a measurement, which may be referred to as a score, include, but are not limited to, counting, tallying, finding a maximum, finding a minimum, calculating (such as a percentage), converting to an integer scale, or the like. Examples of attributes include, but are not limited to, the total number of pixels in an area to be printed, the number of pixels within specified areas of a total image to be printed, the relationship between the ink on the image receiving member and the media or other printer components, the quantity or occurrence of pixel patterns in a print image, the nature of the colors present, or the like. The logical decisions and analysis performed with reference to the attributes may be the same or different based on whether the image is a first or second side image or an image for a first or subsequent media sheet in a plurality of media sheets. For example, comparison of an ink coverage measurement to a predetermined threshold may use the same or different thresholds for a first or second side image or an image for a first or subsequent media sheet in a plurality of media sheets. Also, comparisons described in this document are frequently described as exceeding a threshold. This description is meant to encompass the value being greater than the threshold or less than the threshold depending on the context of the comparison. Thus, exceeding a threshold may refer to a value greater than a maximum in one instance, and less than a minimum in another. In the case of FIG. 6, a preferred threshold is set at an approximately 20% of the surface area for a document image area on the image receiving member being covered with ink (block 208). The disclosed embodiment calculates the pixel density based on a digital representation of the images to be printed stored in a memory of the disclosed printing system. This digital representation is the same representation that the system's controller and print heads use in controlling the deposition of ink onto the image receiving member. Values less than the 20% threshold indicate that the printer can be operated with the print process in the disclosed manner that yields higher throughput without suffering from image dropout. Conversely, if the surface area covered in print pixels is above the approximately 20% threshold, the system uses another printing method that may be known to the art (block 210).

Referring again to FIG. 6, the first side image is formed on the rotating image receiving member and then the image receiving member is stopped (212). The transfix roller is moved into a position that forms the nip with the image receiving member with the media sheet present (block 214). Next, the image receiving member begins to rotate and accelerate to a predetermined transfix speed (block 216). The first medium sheet then passes through the nip and the first image is transfixed from the first pitch on the image receiving member to the first side of the media sheet (block 220). While the embodiment of this method discloses a drum as the image receiving member, alternative embodiments may use other image receiving members. For example, the imaging receiving member may be a platen or an endless belt.

Again referring to FIG. 6, in instances where there are two or more first side images on the image receiving member, more first side sheets are needed to complete the transfixing of all of the first side images (block 224). In between the trailing edge of one media sheet exiting the nip ("roll off") and the entry of another media sheet into the nip ("roll on"), a portion of the image receiving member known as the inter-document gap rotates through the nip (block 228) which, in this example, is performed while the image receiving member is at the transfixing velocity. The reader should note that the transfix roller makes direct contact with the image receiving member and therefore picks up some release agent. However, because the image content has been determined to be below the threshold (208), the consequence of this release agent being on the transfix roller is not likely to cause print quality defects, such as image dropout. Once the next media sheet enters the nip, the first-side image in the second pitch on the image receiving member corresponding to that sheet has rotated into position and the next image is transfixed to the next sheet (block 220). If more sheets are to have images transfixed to their first sides (block 224), the transfix roller remains in the nip position and the image receiving drum continues to rotate until each media sheet has its first side transfixed with an image from a corresponding pitch. One known embodiment of this cycle involves moving two media sheets through the nip for the transfixing of two first-side images from two pitches to the front sides of two media sheets.

Continuing to refer to FIG. 6, after the front side of the last sheet in the plurality of media sheets has been transfixed with a first side image, the transfix roller is moved away from the image receiving member (block 232). This movement enables the image receiving member to rotate at a higher image formation speed without the need to decelerate to a stop or near zero velocity in order to disengage the transfix roller while media is still present in the nip. Again, the reader should note that as the transfix roller is disengaged from the image receiving member while at or near transfix velocity, the transfix roller makes incidental contact with the image receiving member and picks up some release agent. As mentioned earlier, the consequences of this release agent acquisition on the transfix roller are slight because low coverage prints, as determined by block 208, are less at risk for this print quality defect. After the image receiving member reaches image formation speed, the second side images are formed on two pitches on the image receiving member (block 236). While the image receiving member has been described as accelerating to an image formation speed, the image receiving member may optionally rotate at a speed that is different, either higher or lower, than the transfix speed at which it rotated during the transfixing of the first side images on the front sides of the media sheets. The process continues with the transfix roller being returned to the position where the nip is formed with the image receiving member (block 240).

The first media sheet passes through the nip and, the second side is transfixed with a second side image from a first pitch on the image receiving member (block 244). If more sheets are to have images transfixed to their second sides (block 246), the transfix roller remains in the nip position and the image receiving member continues to rotate (block 250) until each media sheet has its second side transfixed with an image from a corresponding pitch. After the last sheet has its second side transfixed, the image receiving member is stopped and the transfix roller is moved away from the nip position (block 248). In this situation, the transfix roller does not make contact with the image receiving member, and therefore does not pick up release agent, because the image receiving member was first stopped while the media was still in the nip. Because the transfix roller did not pick up release agent prior to being disengaged from the image receiving member, the transfix roller is in a condition that is "safe" if the next duplex print has high ink coverage and thus being at risk for image dropout.

Referring again to FIG. 6 and specifically to blocks 204, 206, 208, this embodiment describes one of many possible logical operations. In this embodiment, the image content of only the first side of the image that is about to be printed is analyzed. In more elaborate embodiments, the selection of the normal process (210) or a higher throughput process (beginning with 212) could be determined by analyzing a variety of coverage parameters for side 1 and/or side 2 images to be printed, side 1 and/or side 2 of a previously printed image, and/or the analysis of side 1 and/or side 2 of an image that has been processed by the controller but is still waiting in the "print queue". As an example, in such an alternative condition, assessing the image content of the next image or next pair of images with respect to completion of the current transfix process, may allow on-the-fly roll off of the final current sheet if subsequent image content is compatible with the desired higher throughput operation.

The predetermined threshold may be a printing process timing sequence area coverage threshold, such as those discussed above, or another threshold that indicates the type of printing process timing sequence that is useful in transforming operation of the printer to a more optimal state. Thereafter, the controller measures image content of one or more images to be printed by the printer, selects an appropriate printing process timing sequence in response to the result of the comparison of the measured image content to a predetermined threshold, and then transforms the operation of the printer in accordance with the selected printing process timing sequence. Upon the receipt of addition image data, the controller continues to operate the printer in a similar manner.

It will be appreciated that variations of the above-disclosed and other features and functions, or alternatives thereof, may by desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A printer comprising:

an image receiving member;

a printhead configured to eject ink drops onto the image receiving member to form an ink image;

a transfix roller configured to move towards and away from the image receiving member to form a transfixing nip with the image receiving member selectively;

a release agent applicator configured to engage the image receiving member selectively to apply release agent to the rotatable imaging member; and a controller configured to generate firing signals that operate the printhead from image data and to transform operation of the printer from a first printing process timing sequence to a second printing process timing sequence by rotating the image receiving member at a speed during formation of the images on the image receiving member that is faster than a speed at which the controller rotates the image receiving member during transfixing of the first side images in response to a coverage parameter for image data to be printed exceeding a predetermined threshold.

2. The printer of claim 1 wherein the controller is configured to transform operation of the printer to the second printing process timing sequence by rotating the image receiving member continually during transfixing of first side images to first sides of at least two media sheets serially transported through the nip, and during transfixing of at least one second side image to a second side of at least one media sheet having a first side image on the first side of the media sheet.

3. The printer of claim 1 further comprising:

a memory configured to store the image data to be printed onto the image receiving member; and the controller being further configured to measure the coverage parameter for at least one of the first side images from the image data stored in the memory that corresponds to the first side images, and to operate the image receiving member continually during transfixing of at least one of the first side images to the media sheets or of at least one of the second side images to the at least one media sheet in response to the ink coverage parameter of at least one of the first side images being less than the predetermined threshold.

4. The printer of claim 3 wherein the predetermined threshold is approximately 20% of a surface area for a document image area on the image receiving member being covered with ink.

5. The printer of claim 1 wherein the controller is further configured to operate the transfix member to at least initiate movement from a first position to a second position prior to the image receiving member being rotated at the faster speed without an intermediate stop of image receiving member.

6. The printer of claim 1 wherein the controller is further configured to rotate the image receiving member at a speed that is slower than the speed at which the controller rotates the image receiving member during formation of images on the image receiving member and the speed at which the controller rotates the image receiving member during transfixing of the first side images onto the media sheets.

7. The printer of claim 1 wherein the controller is further configured to operate the transfix member to move to a first position forming the nip prior to the first media sheet entering the nip for transfer of one of at least one of the second side images to a second side of the first media sheet.

8. The printer of claim 1 wherein the controller is further configured to stop rotation of the image receiving member prior to an inter-document gap on the image receiving member reaching the nip.

9. A method of operating a printer comprising:

measuring a coverage parameter for image data to be printed; and transforming transfix operation of the printer from a first printing process timing sequence to a second printing process timing sequence by operating the transfix roller to move away from the image receiving member after the transfixing of the first side images to the media sheets and rotating the image receiving member during the image formation on the image receiving member at a speed faster than the speed at which the image receiving member was rotated during transfixing of the first side images in response to the coverage parameter exceeding a predetermined threshold.

10. The method of claim 9, the modification of the transfix operation further comprising:

changing operation of the transfix roller as either a leading edge of a media sheet reaches the transfix roller or a trailing edge of the media sheet reaches the transfix roller.

11. The method of claim 9, the modification of the transfix operation further comprising:

changing operation of the transfix roller during rotation of the transfix roller through an inter-document gap between two pitches on an image receiving member.

12. The method of claim 9, the modification of the transfix operation further comprising:

beginning rotation of an image receiving member to transfer two first side images from the image receiving member to at least two media sheets; and continuing rotation of the image receiving member during transfixing of first side images onto first sides of at least two media sheets in a nip formed between the image receiving member and a transfix member.

13. The method of claim 12 further comprising:

continuing to rotate the image receiving member during transfixing of the at least one second side image onto a second side of at least one media sheet to which a first side image was transfixed.

14. The method of claim 13 further comprising:

stopping rotation of the image receiving member after the transfixing of the second side image to a media sheet.

15. The method of claim 9, the modification of the transfix operation further comprising:

comparing the measured coverage parameter for at least one first side image with the predetermined threshold; and rotating the image receiving member without stopping during the transfixing of the at least one first side image in response to the measured coverage parameter of the at least one first side image being less than the predetermined threshold.

16. The method of claim 9, the modification of the transfix operation further comprising:

comparing the measured coverage parameter for at least one second side image with the predetermined threshold; and rotating the image receiving member without stopping during the transfixing of the at least one second side image in response to the measured coverage parameter of the at least one second side image being less than the predetermined threshold.

* * * * *